United States Patent [19]

Klam et al.

[11] Patent Number: 4,812,710

[45] Date of Patent: Mar. 14, 1989

[54] HALOGEN INCANDESCENT LAMP WITH HIGH RELIABILITY FILAMENT CONNECTION, AND METHOD OF MANUFACTURE

[75] Inventors: Rüdiger Klam, Eichstätt; Rupert Mühlberger, Ingolstadt; Karl Stadler, Adelschlag, all of Fed. Rep. of Germany

[73] Assignee: Patent Treuhand Gesellschaft fur elektrische Gluhlampen mbH, Munich, Fed. Rep. of Germany

[21] Appl. No.: 24,708

[22] Filed: Mar. 11, 1987

[30] Foreign Application Priority Data

Mar. 24, 1986 [DE] Fed. Rep. of Germany ..... 3609908

[51] Int. Cl.[4] ..... H01K 1/50; H01K 1/18

[52] U.S. Cl. ..... 313/579; 313/271; 313/273; 313/278; 313/623; 445/32; 445/48

[58] Field of Search ..... 313/579, 271, 272, 273, 313/278, 580, 344, 625, 316, 628, 331, 631, 333; 445/46, 48, 49, 29, 32, 35

[56] References Cited

U.S. PATENT DOCUMENTS

| | | | |
|---|---|---|---|
| 2,830,217 | 4/1958 | Hodge | 313/333 |
| 3,069,582 | 12/1962 | Reilly et al. | 313/271 |
| 3,148,267 | 9/1964 | Moore et al. | 219/153 |
| 3,189,778 | 6/1965 | Brundige | 313/271 X |
| 3,440,473 | 4/1969 | Smith et al. | 313/271 |
| 3,484,644 | 12/1969 | Pertwee | 313/271 X |
| 3,930,177 | 12/1975 | Martin | 313/271 |
| 4,359,665 | 11/1982 | Morris et al. | 313/279 X |
| 4,366,411 | 12/1982 | Robinson | 313/273 |
| 4,499,401 | 2/1985 | Graves et al. | 313/315 |
| 4,568,854 | 2/1986 | Westlund, Jr. et al. | 313/579 |
| 4,570,104 | 2/1986 | Janssen et al. | 313/331 |
| 4,658,180 | 4/1987 | Ooms | 313/278 X |

OTHER PUBLICATIONS

"IES Lighting Handbook", Third Edition, 1959, pp. 8–5; 8–6.

*Primary Examiner*—David K. Moore
*Assistant Examiner*—Michael Horabik
*Attorney, Agent, or Firm*—Frishauf, Holtz, Goodman & Woodward

[57] ABSTRACT

To permit easy attachment of a coiled filament, and especially a coiled-coil or double-twist filament, to the current supply leads within a lamp bulb, in which the current supply leads are made of tungsten, each current supply lead is flattened to form a plate-like flattened surface in the vicinity of the terminal end of the current supply lead. The secondary coiling of a coiled-coil filament—or the single coil of a single-coiled filament—is then slipped over the end portion of the lead-in to extend over and about the flattened portion and with a few turns adjacent the flattened portion and therebeyond on the end portion (15) of the current lead-in, thereby retaining the end portion in position due to the additional width of the flattened portion while providing a reliable electrical contact. The greatest width of the flattened portion is slightly greater than the inner diameter of the secondary coiling of the filament (13), for example about 5% to 20% wider.

11 Claims, 6 Drawing Sheets

HALOGEN INCANDESCENT LAMP WITH HIGH RELIABILITY FILAMENT CONNECTION, AND METHOD OF MANUFACTURE

The present invention relates to halogen incandescent lamps, and more particularly to an arrangement and a method to attach the filament of a halogen incandescent lamp to a current supply lead.

BACKGROUND

Halogen incandescent lamps customarily have a bulb or envelope of hard glass or quartz glass, within which a coiled incandescent filament is located. The coiled incandescent filament may have portions or sections thereof which are straight, that is, not coiled. A mount is enclosed in the bulb or envelope, which has at least two inner current supply leads. The current supply leads typically are of molybdenum, and are connected to outside terminals over molybdenum foils or the like, sealed in a press or pinch seal closing off the bulb. The filament may be a coiled or a double-twist filament. It is usually made of tungsten wire.

It has been found that mount components made of molybdenum decrease the lifetime of halogen incandescent lamps due to problems which arise in connection with the halogen cycle. To reduce such problems, it has been proposed to make the inner metallic components, especially the current supply leads, of tungsten. Tungsten is very brittle, and it has been found effectively impossible to insure a reliable mechanical connection as well as an excellent electrical terminal connection between current supply leads and the filament by a clamp or compressed sleeve connection. Such clamp connections can be used, however, with molybdenum leads, since molybdenum is substantially less brittle than tungsten—see German Patent Disclosure Document DE-OS No. 21 26 796.

It has also been proposed to slip the end of the coiled incandescent filament on the current supply lead wire. The diameter of the current supply lead wire is selected to be slightly smaller than the inner diameter of the coil forming the filament. Mechanical retention, as well as electrical connection of such an arrangement, is not reliable, however, and may lead to intermittent terminal connections. This makes it especially difficult to connect halogen cycle incandescent lamps in a dimmer circuit, and to dim the output of the filament. The capability to dim incandescent lamps makes them especially suitable for many applications and is desirable for many uses.

It has been suggested to hot-crimp or bend the current supply leads in advance of slipping the coil of the coiled filament thereover, in order to obtain, for example a hanger connection. U.S. Pat. No. 3,930,177 describes such an arrangement in which the filament coil is placed over a bent-out end portion of a support wire forming a current lead-in. Such arrangement contributes substantially to production time and costs, and also cannot be readily automated on production machinery. In spite of such efforts, the terminal contact between the coiled filament and the tungsten lead-in wire was not improved to result in an entirely satisfactory electrical and mechanical connection.

THE INVENTION

It is an object to provide a halogen incandescent lamp, and manufacturing method therefor, in which the connection between a double-twist, or coiled-coil incandescent filament and the current supply lead is reliable and energy-efficient, that is, which provides a reliable mechanical and electrical terminal connection, and which, additionally, is easy to carry out so that it can be readily mechanized.

Briefly, the diameter of the internal current supply lead is selected to be slightly less than the inner secondary coil diameter of an end portion of the filament and, in a region inwardly of the terminal end, is formed with a flattened, plate-like surface, for example by squeezing the wire. The flattened, plate-like surface extends, laterally, slightly wider than the inner diameter of the coiled end portions of the filament. The coiled end portions of the filament surround the entire end portion of the current supply leads from about the terminal end thereof, over the flattened,plate-like surface, and over an adjacent portion of the current supply lead. Thus, the coiled filament will be held tightly against mechanical removal by the flattened, plate-like portion while, still, being capable of being slipped over the terminal end of the lead-in wire without difficulty. The electrical connection between the lead-in wire and the coiled filament, likewise, is excellent since the coiled filament will engage over and around the flattened end portion besides the remaining sections thereof engaging around the current lead-in. Thus, a tight engagement of the respective current carrying elements is insured, resulting in an excellent electrical contact.

In accordance with a feature of the invention, the inner current supply leads are heated and deformed adjacent the terminal ends to form the flattened surface, and then the filament and the terminal end portions are aligned with each other whereupon the filament is slipped over the end of the current supply lead in such a manner that at least two windings of the coiled filament extend beyond the flattened, plate-like portion so that the filament will be held securely against slipping off the end portion of the lead wire.

The diameter of the inner current supply leads is just slightly less than the inner diameter of the coil at the end of the filament, for example by about between 5% to 20% less. This insures simple threading of the ends of the filament on the lead-in.

The flattened, plate-like portion adjacent the terminal ends of the lead-ins has a width which is slightly greater than the inner diameter of the coil, for example between about 5% to 30% greater. This insures excellent electrical engagement and contact while providing reliable mechanical retention of the filament over the entire lifetime of the lamp. The end region of the lead-ins is preferably angled off from the axis of the lamp by an angle of between about, for example 45° to 90°. The length of the portion which is angled off is preferably such that the distance of the flattened portion from the angle joint is substantially greater than the distance of the flattened portion to the terminal end of the lead-in. This facilitates threading of the filament on the lead-in.

In accordance with a preferred feature of the invention, the filament is bent off from the lead-ins by between about 90°±45°. This permits a laterally acting tensioning of an already tensioned filament, which further improves the electrical contact connection in the region of the end portions of the filament, and results in an additional holding function.

The filament is a coiled-coil or double-twist filament. The inner diameter of the secondary coil at the ends of the filament of the coiled-coil filament is slipped over the end portions of the lead-in. Use of a coiled-coil filament results in high elasticity and additionally supports the holding function of the flattened end portion. Upon tensioning of the filament, the inner diameter of the secondary coiling or winding decreases, thus holding the filament against the flattened portion with even better engagement and higher reliability, due to self-clamping or self-tensioning effect.

Preferably, the incandescent filament is formed in the vicinity of its ends with an interruption free from a secondary winding. This interruption permits clearly defining the length of the center portion of the filament which is intended to provide the light output. The ends of the filament, intended for attachment, are therefore limited and defined.

DRAWINGS

Figure 3A:
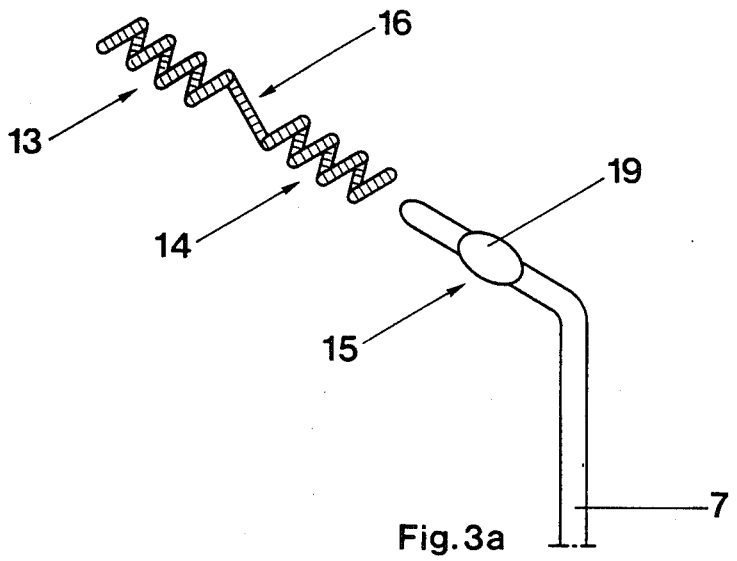
Figure 3B:
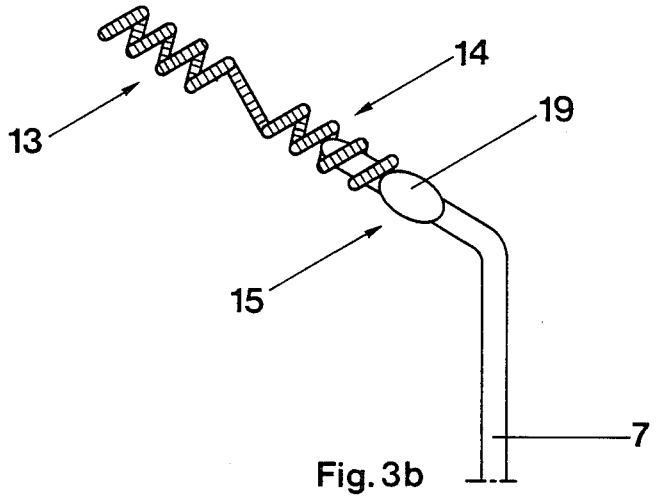
Figure 3C:
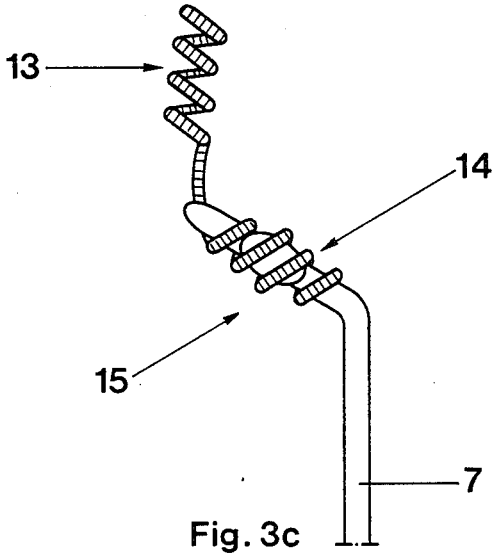
Figure 4:
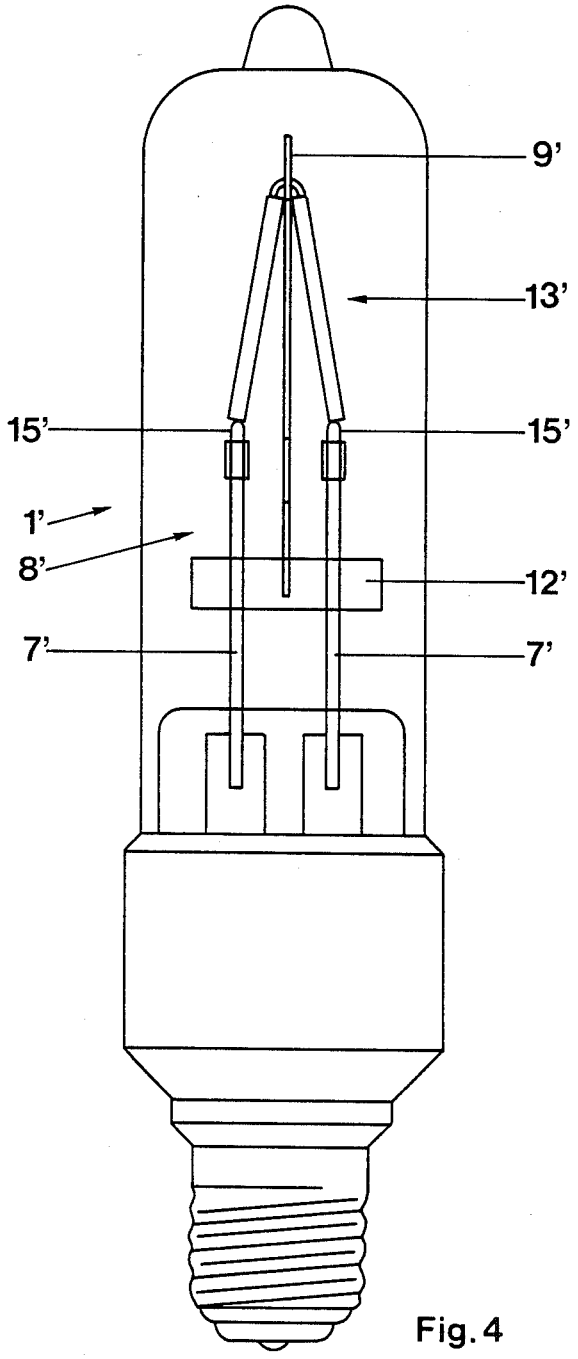
Figure 5:
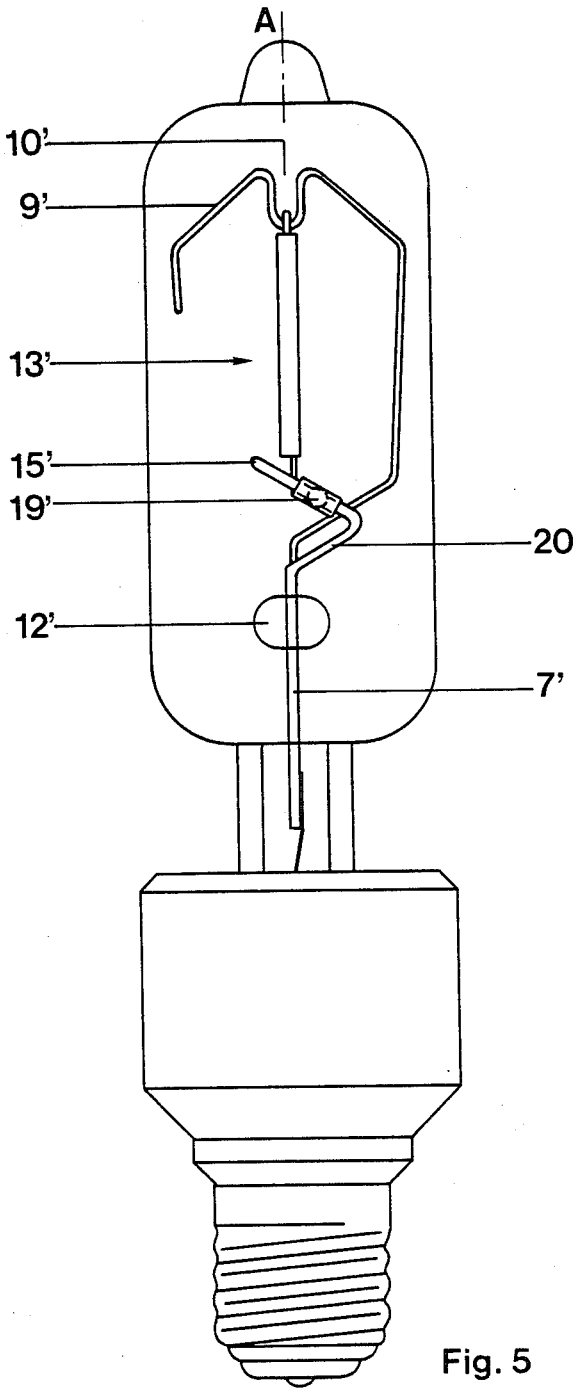

FIGS. 3*a*, 3*b*, 3*c* are drawings showing sequential steps in assembling the end of a filament on a current lead-in, from first positioning (FIG. 3*a*), an intermediate step (FIG. 3*b*) and final positioning (FIG. 3*c*);

FIG. 4 is a front view of another embodiment of a halogen incandescent lamp in accordance with the present invention; and FIG. 5 is a side view, rotated 90° with respect to FIG. 4, of the lamp of FIG. 4.

DETAILED DESCRIPTION

Figure 1:
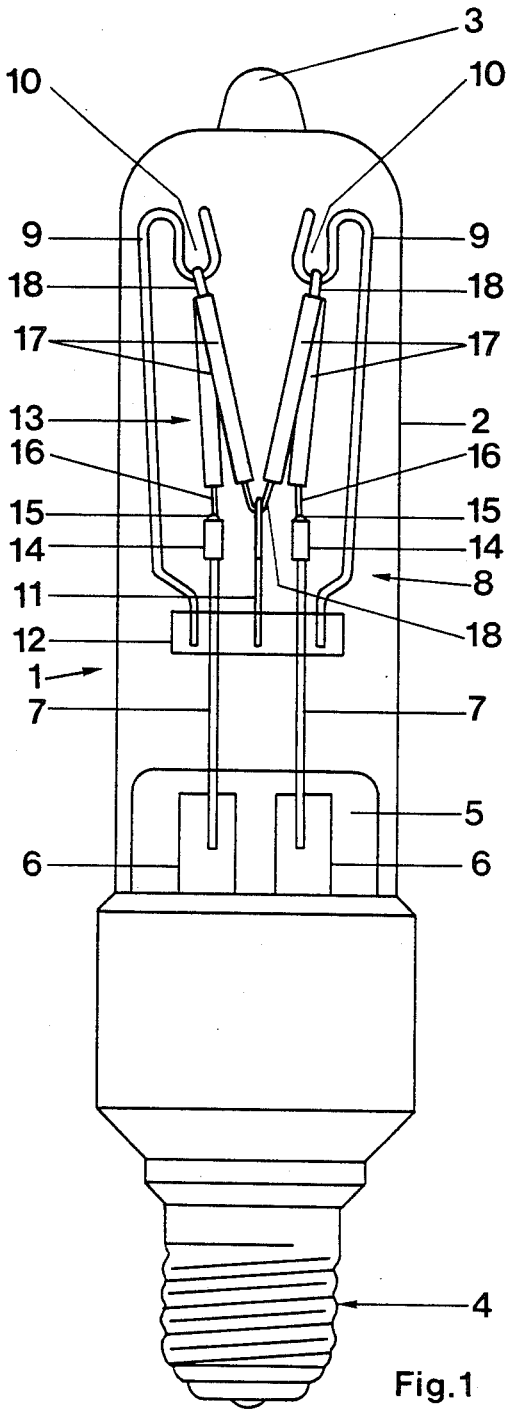
FIG. 1 is a front view of a halogen incandescent lamp made in accordance with the present invention.
Figure 2:
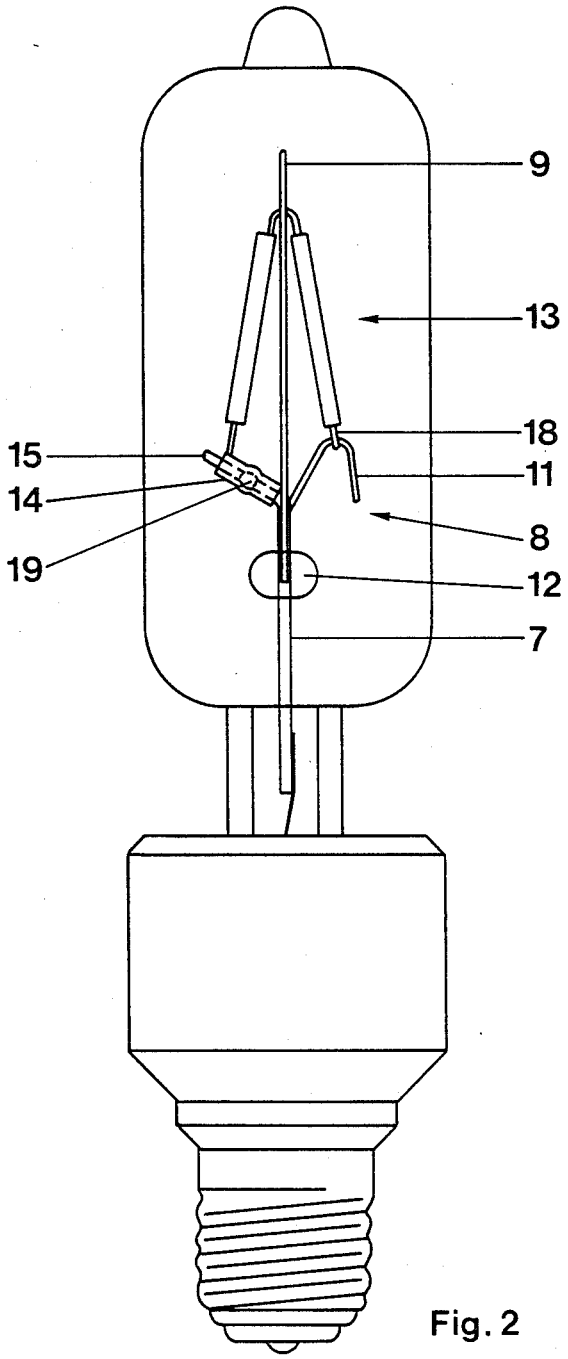
FIG. 2 is a side view of the lamp, rotated 90° with respect to the view of FIG. 1.

The lamp shown in FIGS. 1 and 2 is, for purposes of illustration, a 220 V halogen incandescent lamp with a power rating of 150 W. The lamp 1 has a quartz envelope 2, which is filled with a halogen compound and one or more inert gases. It is tipped off at 3 after filling. A metal base 4 retains the lamp in position. The lamp bulb or envelope 2 is sealed at the end facing the base 4 by a press seal 5. The press seat 5 retains molybdenum foils 6, melted therein, which are, in turn, connected to external current lead-ins which are connected to the respective terminals of the screw-in base. These external—not visible—connecting leads are made of molybdenum. The molybdenum foils 6, melted in the press 5, are secured to inner current supply leads 7, for example by welding. The inner supply leads 7 are made of tungsten. The molybdenum foils permit current transfer through the press, while retaining the interior of the bulb 2 in vacuum-tight condition.

The two inner current supply leads 7 are part of a mount 8 which, besides the current supply leads, includes a holding structure formed by holder wires 9, formed at their upper ends—with respect to FIG. 1—with meander-shaped bends 10 terminating in an end hook. An additional lower hook-like part 11 (FIG. 2) is secured in the lamp and forms part of the mount 8. The components of the mount 8 are secured in position by a cross element 12 made of quartz glass. The upwardly extending filament holders 9 are made of tungsten wire and are located in one plane.

A coiled-coil filament 13, of tungsten wire, is provided separated into a plurality of sections or portions. The two end portions 14 are secured to end portions or end sections 15 of the inner current supply leads 7. The secondary winding or coiling of the filament is interrupted, as shown at 16, and at the interrupted region, the filament 13 is bent off from the inner current supply leads 7, as best seen in FIG. 2. Four double-twisted or coiled-coil filament sections 17 are placed adjacent the interruption 16. The four portions 17, in vertical projection, are M-shaped, separated from each other by portions 18 free from secondary coiling. At the regions 18 where the filament is not secondarily coiled, the filament is held by the mount 8, or, more specifically, by the hook-like ends of the meander-shaped bends 10 of the holders 9 and by the hook-like element 11. The coiled-coil filament portions 17, thus, are held in spread-apart condition—see especially FIG. 2, which clearly shows that the hook part 11 is bent from a central axis of the lamp in the direction away from leads 7.

FIG. 2 clearly shows the arrangement of the filament 13, in space. To avoid spark-over the end portions 14 of the filament and the central section 18 (FIG. 1), free from secondary windings, are removed from the central plane of the lamp. This plane, which can be defined as a plane passing through both of the holders 9, is referred to as a reference plane. The two end portions 15 of the inner current supply leads 7 are bent-off in a plane perpendicular to the reference plane, and perpendicular to the orientation of the cross element 12, both in the same direction. Only one of the bent-over ends 15 is visible in FIG. 2. The hook-like holder 11, likewise, is bent away in a plane perpendicular to the reference plane, and parallel to the planes of bending of the end portion 15. The bending direction is opposite to the end portions 15.

The retention of the filament 13 at the end portions 15 of the inner current supply leads is best seen in connection with FIG. 3—collectively—by a flattened or plate-like region 19 formed on the end portions 15 of the current supply leads 7.

Retention of Filament, and Method of Assembly, with reference to FIGS. 3*a*–3*c*:

The inner diameter of the secondary winding of the filament is formed with an interruption 16 in the vicinity of the filament end. The inner diameter of the secondary winding is about 0.6 mm. The inner current supply lead 7 has a diameter of about 0.55 mm. The length thereof—in straight direction—is about 18 mm.

The end portion 15 of the inner current supply lead 7, terminating in a free terminal end, is angled off by about 60° for a length of about 5 mm. The thus formed angled-off end portion 15 of the inner current supply lead is squeezed or press-deformed, about 2 mm from the terminal end thereof, to result in a plate-like flattened essentially, in plan view, oval or elliptical deformation 19 (see FIG. 3*a*). Squeezing or flattening is preferably done by two cylindrical punches or punch stamps, which simultaneously engage a lead-in wire 7, at the end portion 15, from both sides. The flattened portion 19, thus, is widened in the plane formed thereby, to have a largest width of about 0.66 mm. The end portion 15 of the lead 7 also becomes thinner at the wider portion, that is, the flattened portion 19 will be thinned to about 0.44 mm. Deformation is preferably done while heating ends 15.

In assembly, and first looking at FIG. 3*a*, the end of the filament 13 and the end portion 15 of the inner current supply lead are aligned with respect to each other. Thereafter, the filament 13 is threaded from one end on the terminal end and then on the end portion 15. This threading is done in such a way that at least two, in general however, and preferably, about 5 windings of the secondary winding of the end portion 14 of the filament are slipped over and beyond the flattened portion 19 on the end portion 15 of the current supply lead 7. This retains the filament 13 on the end portion 15—as best seen in FIG. 3c, from which multiple windings have been omitted for clarity.

The other end 14 of the filament 13 is then connected to the second inner current supply lead 7—or the two connections can be done simultaneously. Both inner current supply leads 7 are already fixed in position by the cross element 12 of quartz glass forming part of the mount 8. The then still hanging filament 13 is bent upwardly in the region of the interruptions 16—see FIG. 3c—and, as can readily be seen with reference to FIGS. 1 and 2, guided over the hook-meander ends 10 of the holders 9 and then hooked into the hook 11. FIG. 4 shows a lamp 1' in accordance with the invention for 110 V and of 75 W power rating.

The lamp 1', of FIG. 4, generally, is of the same construction as the lamp 1 of FIGS. 1 and 2, except that the mount is constructed somewhat differently. Further, the operating voltage is half, and the filament 13' is reduced in length by about half. The filament 13' is placed in position in shape of an inverted V. Filament 13', thus, requires a different mount, as seen at the mount 8'. The cross element 12' has to retain only a single filament holder 9' with a meander-shaped bend 10' (FIG. 5) therein. Two inner current supply leads 7'—see FIGS. 4 and 5 are secured to the cross element 12' to complete the mount. The two inner current supply leads 7' are bent in a plane parallel to the plane of the holder element 9'.

The current supply leads 7' are formed as shown in FIG. 5, with a short intermediate bent section 20, bent in a direction opposite the respectively bent-over end portions 15' on which the flattened regions 19' are formed. The region 20 is short with respect to the end portions 15'. In projection—as best seen in FIG. 5—each end portion 15' is so placed that it can intersect a longitudinal central axis A of the bulb 2'. The flattened plate-like surfaces 19' are placed in advance of the intersection of the end portions 15' from the central axis A—looked at from the connection to the intermediate portion 20. This permits placement of the incandescent filament 13' in the center, that is, coplanar with the central axis A, the plane of the incandescent filament being perpendicular to the plane of the holder 9' which also passes through the central axis. The filament is stretched between the end portions 15' of the leads 7' and the hook end 10' of the holder 9'. For assembly, the filament is placed on the inner end portions 15' as described in connection with FIGS. 3a–3c; the current leads 7' need only have a diameter of 0.44 mm, the width of the flattened portion 19' can be 0.55 mm, and the inner diameter of the secondary winding 0.48 mm.

Various changes and modifications may be made, and the invention can be used with various and different types of lamps. For example, the invention may be used with coiled-coil filaments which do not have any portions free of secondary windings, or interruptions. It is not necessary that the lead-in wires 7, 7' be formed with angled-off end portions 15, 15' at the inner region.

Various other changes and modifications may be made within the scope of the inventive concept.

We claim:

1. Halogen incandescent lamp (1, 1') having a bulb (2, 2');

a coiled-coil filament (13, 13'), said coiled-coil filament having a smaller diameter primary coiling and a secondary coiling of a diameter larger than said primary coiling, said coiled-coil filament being located in the bulb;

a filament mount (8, 8') including at least two internal current supply leads (7, 7'), of tungsten wire material to facilitate operation of the lamp in a halogen cycle, said filament mount having end portions (15) secured to end portions of the filament; and a pinch or press seal (5) including at least two foil elements (6) sealed therein, closing off the bulb or envelope and electrically and mechanically securing the current supply leads therein, wherein the filament is separated into a plurality of coiled-coil portions including two coiled-coil end portions;

said internal current supply leads each having a diameter slightly less than the inner diameter of the secondary coiling of the end portions of the filament (13, 13');

the end portions of the internal current supply leads (7, 7') are formed with flattened, plate-like surfaces (19, 19') positioned inwardly of the terminal ends of said end portions, said flattened, plate-like surfaces having a lateral dimension slightly greater than the inner coil diameter of the secondary coiling of said end portions of the filament (13, 13'), and having a thickness less than the thickness of the remainder of the current supply leads; and wherein the coiled-coil end portions of the filament (13, 13') surround the end portions of the internal current supply leads from about the terminal ends thereof, extend, under tension, over said flattened, plate-like surfaces (19, 19') and over an adjacent portion of internal current supply leads (7, 7'), so that, upon tensioning of the filament, the inner diameter of the secondary coiling decreases, thus holding the filament against the flattened plate-like surfaces, due to a self-clamping or self-tensioning effect of the tensioned coiled-coil filament.

2. The lamp of claim 1, wherein the end portion (15, 15') of each of the internal current supply leads (7, 7') is angled off from a portion of the current supply leads extending from said mount (8, 8'), said plate-like surface (19, 19') being formed on said angled-off portions, and the length of said angled-off portion is substantially longer than the distance of the flattened, plate-like surface from the terminal end of the end portion of the internal current supply lead.

3. The lamp of claim 2, wherein the angle of the angled-off portion is between 45° to 90° with respect to a longitudinal axis of the lamp.

4. The lamp of claim 1, wherein the filament (13) is formed with a region or zone (16) free from secondary coiling near its end portions.

5. The lamp of claim 1, wherein the diameter of the internal current supply leads (7, 7') is about 5% to 20% smaller than the inner diameter of said secondary coil at the ends of the filament (13, 13').

6. The lamp of claim 1, wherein the maximum width of said plate-like surface (19, 19') is between about 5% to 30% wider than the inner diameter of said secondary coil at the end portions of the filament (13, 13').

7. The lamp of claim 1, wherein the filament (13, 13') has an angled-off or bent portion by between about 90°±45° with respect to the end portion (15) of the internal current supply leads (7, 7').

8. The lamp of claim 1, wherein said flattened, plate-like surface comprises a deformed surface region of the end portion (15), of each of the internal current supply leads (7,7'), having a width in the range of about 5% wider to 30% wider than the diameter of the remainder of each current supply lead .

9. The lamp of claim 1, wherein said flattened, plate-like surfaces (19), in plan view, are essentially oval.

10. A method to manufacture a halogen incandescent lamp as claimed in claim 1, said lamp having a bulb (2, 2');

a coiled-coil filament (13, 13') located in the bulb which is doubly coiled at least over part of its length to form coiled-coil portions or secondary coiled portions, the coiled-coil or secondary coiled portions defining an inner coil diameter;

a filament mount (8, 8') including at least two internal current supply leads (7, 7') of tungsten wire material having end portions (15) secured to the coiled-coil end portions of the filament; and a pinch or press seal (5) including at least two foil elements (6) sealed therein, closing off the bulb or envelope and electrically and mechanically securing the external current supply leads therein, comprising the steps of deforming the end portions (15) of the internal current supply leads (7, 7') to form flattened, plate-like surfaces located inwardly of the terminal ends of said end portions;

aligning end portions of the doubly coiled filament with the end portions of the current supply lead;

and fitting the end portions of the doubly coiled filament lead over the end portions of the current supply leads, while stretching the end portions of the filament over the flattened, plate-like surfaces (19, 19'), and extending the end portions of the filament to place at least two secondary coil windings of the end portions of the filaments over the flattened, plate-like surfaces.

11. The method of claim 10, wherein the step of deforming the end portion of the internal current supply lead comprises squeeze or punch-deforming the end portion of the current supply lead while supplying heat thereto.

* * * * *